US009388783B2

(12) United States Patent
Becker

(10) Patent No.: US 9,388,783 B2
(45) Date of Patent: Jul. 12, 2016

(54) FASTENING ARRANGEMENT OF A FUEL SUPPLY DEVICE ON AN INTERNAL COMBUSTION ENGINE

(75) Inventor: Jürgen Becker, Landshut (DE)

(73) Assignee: AUDI AG, Ingolstadt (DE)

( * ) Notice: Subject to any disclaimer, the term of this patent is extended or adjusted under 35 U.S.C. 154(b) by 353 days.

(21) Appl. No.: 13/885,361

(22) PCT Filed: Nov. 14, 2011

(86) PCT No.: PCT/EP2011/005713

§ 371 (c)(1),
(2), (4) Date: May 14, 2013

(87) PCT Pub. No.: WO2012/065706

PCT Pub. Date: May 24, 2012

(65) Prior Publication Data

US 2013/0233280 A1 Sep. 12, 2013

(30) Foreign Application Priority Data

Nov. 15, 2010 (DE) ..... 10 2010 051 488

(51) Int. Cl.
*F02M 61/14* (2006.01)
*F02M 55/00* (2006.01)
(Continued)

(52) U.S. Cl.
CPC ..... *F02M 61/14* (2013.01); *F02M 55/004* (2013.01); *F02M 55/025* (2013.01); *F02M 69/465* (2013.01); *F02M 2200/803* (2013.01); *F02M 2200/857* (2013.01)

(58) Field of Classification Search
CPC ... F02M 61/14; F02M 69/465; F02M 55/025; F02M 55/02; F02M 55/004
See application file for complete search history.

(56) References Cited

U.S. PATENT DOCUMENTS 6,148,799 A 11/2000 Leipelt et al.
6,405,711 B1 6/2002 Smith et al.
(Continued)

FOREIGN PATENT DOCUMENTS

DE 101 03 250 8/2001
DE 102009014399 8/2010
(Continued)

OTHER PUBLICATIONS

International Search Report issued by the European Patent Office in International Application PCT/EP2011/005713 on Feb. 27, 2012.

*Primary Examiner* — Lindsay Low
*Assistant Examiner* — Jacob Amick
(74) *Attorney, Agent, or Firm* — Henry M. Feiereisen LLC.

(57) ABSTRACT

A fastening arrangement for a fuel supply device on an internal combustion engine includes a fuel distribution element which runs along a longitudinal direction and has at least two connection openings for connecting a fuel injection device. The arrangement is fastened to the internal combustion engine by a connecting element connected to the fuel distributing element via a receiving element having a seat which completely surrounds at least an outer circumferential region of the fuel distributing element. A location of the fuel distributing element lies on a straight line connecting the two connection openings in an elongation of the connecting element in an extension direction thereof. The extension direction and a surface normal of the supporting surface enclose with one another an angle different from zero degrees.

16 Claims, 6 Drawing Sheets

(51) Int. Cl.
*F02M 55/02* (2006.01)
*F02M 69/46* (2006.01)

(56) References Cited

U.S. PATENT DOCUMENTS

| | | | | |
|---|---|---|---|---|
| 2001/0010216 | A1 | 8/2001 | Usui et al. | |
| 2007/0163545 | A1* | 7/2007 | Beardmore et al. | 123/456 |

FOREIGN PATENT DOCUMENTS

| | | |
|---|---|---|
| EP | 2 072 806 | 6/2009 |
| JP | 2010-019132 | 1/2010 |
| WO | WO 97/30282 | 8/1997 |
| WO | WO 2006/105388 | 10/2006 |

* cited by examiner

FASTENING ARRANGEMENT OF A FUEL SUPPLY DEVICE ON AN INTERNAL COMBUSTION ENGINE

CROSS-REFERENCES TO RELATED APPLICATIONS

This application is the U.S. National Stage of International Application No. PCT/EP2011/005713, filed Nov. 14, 2011, which designated the United States and has been published as International Publication No. WO 2012/065706 and which claims the priority of German Patent Application, Serial No. 10 2010 051 488.8, filed Nov. 15, 2010, pursuant to 35 U.S.C. 119(a)-(d).

BACKGROUND OF THE INVENTION

The invention relates to a fastening arrangement of a fuel supply device on an internal combustion engine.

WO 2006/105388 A1 discloses a fuel distribution rail having an elongated tubular body with a wall delimiting a cavity. The elongated tubular body is formed of a thermosetting composite material. The fuel distribution rail includes a pressure connection with a cavity which is fluidly connected with the cavity of the elongated tubular body. The fuel distribution rail may further include a layer with which the elongated tubular body is overmolded and which completely surrounds the elongated tubular body at least in an outer peripheral section. A connecting element is then connected with the overmolded layer, via which the fuel distribution rail is to be connected to a motor.

DE 101 03 250 A1 discloses a conventional line for a diesel engine, which has a main line with a circumferential opening, which extends interiorly in the axial direction. The line further includes branch holes which are formed in a peripheral wall portion of the main line. The distribution line furthermore includes branch connections which are connected to the corresponding branch holes integrally or via separate connecting elements. The line further includes a nickel-diffused reinforcing layer for increasing the fatigue strength, which is formed by heating a nickel layer that was previously plated using pure nickel or a nickel alloy, which is formed on at least a part of the inner peripheral surface of the common line.

These conventional solutions disadvantageously produce undesirable high stress of the fuel distribution rail and/or the line during the operation when fuel is injected into combustion chambers of an internal combustion engine under high pressure, causing them to detach from the internal combustion engine.

SUMMARY OF THE INVENTION

It is therefore an object of the present invention to provide a fastening arrangement of a fuel supply device of an internal combustion engine and a method for fastening a fuel supply device on an internal combustion engine, which improve attachment of the fuel supply device on the internal combustion engine.

The first aspect of the invention relates to a fastening arrangement of a fuel supply device of an internal combustion engine, wherein at least one fuel distribution element extending along a longitudinal direction is fastened on the internal combustion engine by at least one connecting element. The fuel distribution element has at least two connection openings via which the fuel distribution element can be connected to a particular fuel injection device, such as an injector, a fuel injection valve and the like, so that fuel to be received in the fuel distribution element can flow through the connection openings to the fuel injection devices and can be injected therethrough into combustion chambers of the internal combustion engine.

The connecting element is connected to the fuel distribution element via a receiving part having a seat which completely surrounds at least an outer peripheral portion of the fuel distribution element and in which at least a section of the fuel distribution element is received.

According to the invention, a location of the fuel distribution element located on an elongation in the major direction of the connecting element is located on a straight line connecting the two connection openings. The connection part has, for example, a main extension direction, in particular a longitudinal main extension direction. A location of intersection with the fuel distribution element is located on an elongation along the extension direction or along the main extension direction of the connecting element, in particular with an outer peripheral surface thereof, wherein the intersection location is located on the straight line connecting the two connection openings. Preferably, the straight line connects respective centers of the preferably circular connection openings.

By locating the location of the fuel distribution element on the straight line, no or only small transverse forces and/or transverse torques (torsional moments) occur at connection locations of the connection part with the fuel distribution element and at the connection locations of the fuel supply device with the internal combustion engine, which place severe stress on the connection locations, during the operation of the fuel supply device when the fuel is injected into combustion chambers of the internal combustion engine at high pressure. Instead, at least almost only normal forces advantageously occur during the operation, which can be well received and supported by the fuel supply device and/or the internal combustion engine. The fastening arrangement of the invention thus allows a particularly firm connection of the fuel supply device with the internal combustion engine, which remains intact even under high forces caused by the high injection pressures and which has a long service life, without the risk that the fuel supply device detaches from the internal combustion engine.

Moreover, the fastening arrangement advantageously eliminates fastening elements, such as sleeves inserted through the fuel distribution element, and corresponding through-openings through which these fasteners can pass through the fuel distribution element. Such inserted fasteners may cause cracks and hence leaks during the operation of the fuel supply device, unless proper precautions are taken. This risk exists especially in the edge areas of through-openings through which the fasteners extend through the fuel distribution rail. The probability of such a crack- and leak-formation is particularly small in the fastening arrangement according to the invention. The fastening arrangement is thus very robust against high loads and is quite inexpensive.

In an advantageous embodiment, the connecting element is arranged in the longitudinal direction of the fuel distribution element between the connection openings and at least partially midway between the connection openings, thus at least substantially preventing bending moments or producing only very small bending moments. This also reduces stress on the corresponding connection locations, thus extending the service life of the fastening arrangement.

In another embodiment, the connecting element has a central axis, in particular a central longitudinal axis which in elongation intersects the fuel distribution element, in particular the outer surface of the fuel distribution element, at an intersection location of the fuel distribution element, wherein the intersection location is located on the straight line connecting the two connection openings, in particular their centers. This prevents or at least significantly reduces eccentric forces and the resulting moments, keeping the stress of the joints small.

When the connecting element and the connection openings are arranged on a common side of the fuel distribution element, then advantageously mainly only tensile forces need to be absorbed by the at least one connecting element during operation of the fuel supply device in order to hold the fuel supply device on the internal combustion engine, for example a cylinder head. Tensile forces can be particularly well received and supported by the internal combustion engine, the connecting element and the fuel distribution element, because the seat of the receiving part surrounding the fuel distribution element completely surrounds the outer periphery, so that the fuel supply device and the internal combustion engine are only lightly stressed during the operation. This also extends the service life of the fastening arrangement.

In another embodiment, a longitudinal central axis of the fuel distribution element which has for example an elongated and tubular shape, is located in a plane spanned by the straight line and the extension direction of the connecting element. As a result, the fuel distribution element is also at least not substantially exposed to torsional moments and eccentric forces acting on the fuel distribution element during operation of the fuel supply device. The forces acting on the fuel distribution element forces are at least substantially only normal forces, in particular tensile forces, which can be particularly well received and supported. This also promotes a particularly strong and durable attachment of the fuel supply device of the internal combustion engine.

In a particularly advantageous embodiment of the invention, the fastening arrangement includes at least one additional connecting element which is positively and/or reversibly releasably connected to the first connecting element and which is used to mount the fuel supply device on the internal combustion engine. In this way, the fuel distribution element can be connected first to the first connecting element via the seat, whereafter the first connecting element can be connected to the internal combustion engine, for example, to the cylinder head. Thereafter, the fuel distribution element and the first connection part connected thereto can be connected to the internal combustion engine as a module via the already mounted additional connecting element.

This allows a particularly simple, time-saving and cost-effective installation of the fuel supply device on the internal combustion engine. Due to the positive and/or reversibly releasable connection of the two connecting elements, with no material connection being provided, the fuel supply device can hence be disassembled again in a time-saving and cost-effective manner, for example, for repairs. In addition, eliminating a connection also eliminates an undesirably high heat input into the connecting elements and in particular into the fuel distribution element, which may cause distortion of the fuel distribution element and/or the connecting elements, which in turn may adversely affect the attachment of the fuel supply device on the internal combustion engine.

For example, the connecting elements are at least partially, in particular predominantly, rod-shaped, sleeve-shaped or bolt-shaped and are disposed coaxially relative to one another. This allows a particularly precise connection of the connecting elements with one another, as well as the previously described beneficial support of loads occurring during operation, thereby at least substantially preventing torsion moments. An axis, with which the connecting members are coaxially aligned, advantageously intersects the longitudinal center axis of the fuel distribution element so as to eliminate eccentric forces.

In another embodiment of the invention, the connecting elements are connected by a screw element, in particular a nut, particularly a union nut, which is screwed onto one of the connecting elements and is supported on the other of the connecting members by respective limit stops. The screw element has, for example, a collar, which is supported on a limit stop of the corresponding connecting element so as to positively connect the connecting elements with each other, in particular in the axial direction. The screw element makes it possible to connect the connecting elements in a time-saving and cost-effective manner, so that the fuel supply device can be particularly easily, quickly and cost-effectively mounted on the internal combustion engine.

In order to exactly position the two connecting elements relative to each other, one of the connecting elements is preferably at least partially received in a seat of the other of the connecting members. For this purpose, one of the connecting elements may include an alignment pin which is formed, for example, as an extension of the connecting element, while the other of the connecting elements has a corresponding through-opening forming the seat in which the alignment pin is received. The connecting elements can thus be centered with respect to each other for facilitating the above-described support of the loads occurring during operation.

Furthermore, the connecting element, in particular the additional connecting element, may advantageously be at least partially substantially rod-shaped and may have a thread in the rod-shaped region, in particular an external thread, via which the connecting element is screwed to the internal combustion engine, in particular the cylinder head. The connection part can thereby be connected to the internal combustion engine in a particularly time-saving and cost-effective manner, which minimizes installation time and installation costs for mounting the fuel supply device on the internal combustion engine. Moreover, the connecting element may then be connected in the axial direction thereof with the internal combustion engine. Consequently, only at least substantially normal forces, in particular tensile forces, then act on the connecting element. This at least substantially eliminates shear forces, in particular caused by connections extending transversely to the connections or connecting elements. This advantageously provides the very solid and durable attachment of the fuel supply device on the internal combustion engine.

In another advantageous embodiment, the connecting element and the receiving part may be formed integrally as a single piece. This keeps the number of parts and therefore the cost and weight of the fastening arrangement according to the invention low. The connecting element and the integrally formed receiving part are designed, for example, as a cast component, as a welded component made of a plurality of parts welded together, as a brazed component made of a plurality of parts soldered together or as a deep-drawn component.

In order to connect the receiving part and the fuel distribution element with each other particularly firmly, the receiving part and the fuel distribution element are, for example, connected with each other by a material joint. This also prevents an undesirable movement of the receiving part relative to the fuel distribution element, in particular during pre-assembly of the connecting element with the fuel distribution element by way of the receiving part.

In another advantageous embodiment, the connecting element formed integrally with the receiving part is connected directly to the internal combustion engine. Advantageously, the connecting element is supported directly on the internal combustion engine, especially on the cylinder head of the internal combustion engine. This keeps the number of parts and therefore the cost of the fastening arrangement particularly low.

The receiving part and the connecting element are formed, for example, as a one-piece cast part, in particular as so-called cast block. Such a cast block component or cast block can be produced in a particularly time-saving and cost-effective manner. The installation complexity is also particularly low, since only the connecting element formed integrally with the receiving part needs to be installed.

In another advantageous embodiment of the invention, the connecting element or the additional connecting element has at least one supporting surface disposed on the side of the fuel distribution element, on which a fastening element for fastening the connecting element or the additional connecting element can be supported on the internal combustion engine. The fastening element is, for example, a screw which can be used to screw the connecting element or the additional connecting element to the internal combustion engine, in particular the cylinder head.

The screw may be supported on the supporting surface via its screw head so that the connection part or the additional connection part are tensioned with and screwed to the internal combustion engine. Advantageously, the supporting surface is arranged so that is does not at least partially overlap with the receiving part, in particular not at least for the most part and in particular not completely. The fastening means, in particular the screw, can then be attached, in particular tightened, with a tool from the side of the fuel distribution element and thus from the side of the receiving part. The least partially non-overlapping arrangement of the supporting surface thus allows a particularly simple and therefore time-saving and cost-effective installation of the fuel distribution element on the internal combustion engine.

For implementing the at least partial non-overlapping arrangement of the supporting surface and thus for enabling a particularly simple installation, the extension direction and the surface normal of the supporting surface enclose, for example, an angle different from 0°. Advantageously, the angle between the extension direction and the surface normal is greater than 0° and less than or equal to 12°.

Additionally or alternatively, the receiving part may have at least one recess on the outer peripheral side facing away from the fuel distribution element, wherein the recess of the receiving part at least partially prevents the supporting surface from being covered by the receiving part. I.e., the advantageous access to the supporting surface for mounting the fastening means is at least partly realized by the recess in the outer peripheral surface of the receiving part. The angle between the extension direction and the surface normal is thus advantageously kept small, while at the same time realizing the advantageous access to the supporting surface. The fastening arrangement hence requires only a very small installation space.

The second aspect of the invention relates to a method of fastening a fuel supply device having at least one fuel distribution element extending in a longitudinal direction and having at least two connection openings for connecting a respective fuel injection device to an internal combustion engine, wherein in one step of the method, the fuel distribution element is connected with at least one connecting element via a receiving part having a seat, by moving at least a section of the fuel distribution element into the seat. When the fuel distribution has been moved into the seat, the seat completely surrounds at least an outer peripheral portion of the fuel distribution element in the circumferential direction. In an additional step, the fuel distribution element is attached with the connecting element to the internal combustion engine, for example on a cylinder head.

According to the invention, when the fuel distribution element it connected with the connecting element, a location located in an elongation of the extension direction of the connecting element is arranged such that the location is located on a straight line connecting the two connection openings. Advantageous embodiments of the first aspect of the invention are to be regarded as advantageous embodiments of the second aspect of the invention, and vice versa. Because after the fuel distribution element is has been connected to the connecting element, the location of the fuel distribution element is located on the straight line connecting the connection openings, at least substantially no, or only very small undesirable transverse forces and transverse torques (torsional moments) occur during the operation of the fuel supply device at connection locations where the connecting element is connected with the fuel distribution element and/or with the internal combustion engine. The stress of the joints is thus kept small and the fuel supply device can be particularly firmly connected to the internal combustion engine by the method according to the invention, wherein this firm connection is also reliably maintained over a long service life of the fuel supply device.

BRIEF DESCRIPTION OF THE DRAWING

Further advantages, features and details of the invention will become apparent from the following description of a preferred exemplary embodiment and the drawing. The features and combinations of features mentioned above in the description and the features and feature combinations mentioned below in the figure description and/or shown in figured alone can be used not only in the listed combination, but also in other combinations or in isolation, without departing from the scope of the invention.

The drawing shows in.

DETAILED DESCRIPTION OF PREFERRED EMBODIMENTS

Figure 1:
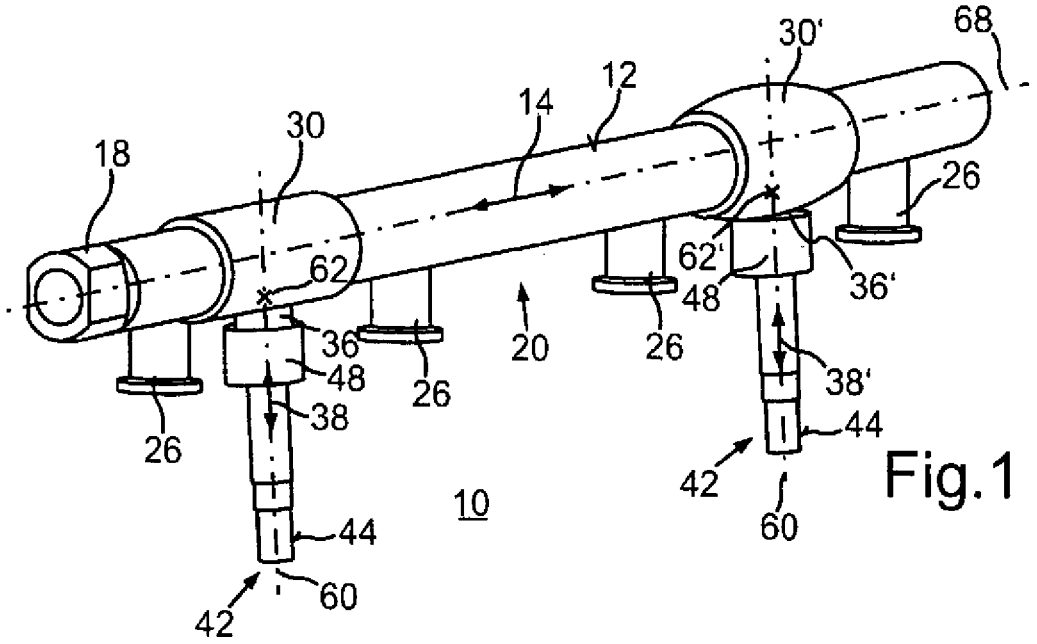
FIG. 1 a schematic perspective view of a fuel supply device for an internal combustion engine, which includes connecting elements for fastening the fuel supply device to a cylinder head of the internal combustion engine.
Figure 2:
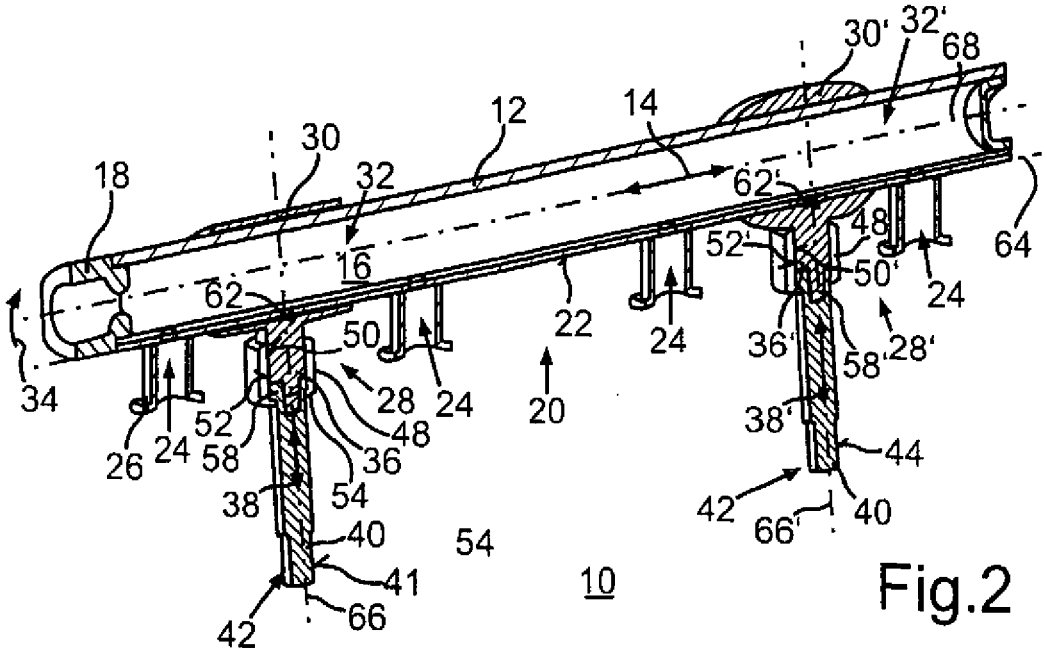
FIG. 2 a schematic perspective longitudinal sectional view of the fuel supply device according to FIG. 1.

FIGS. 1 and 2 show a fuel supply device 10 for an internal combustion engine, in particular a direct-injection gasoline or diesel engine. The fuel supply device 10 includes a fuel distribution rail 12 which extends along a longitudinal direction according to a directional arrow 14. The fuel distribution rail 12 forms an elongated receiving space 16 configured to receive fuel for the internal combustion engine under very high pressure. To this end, the fuel is supplied from a fuel tank by at least one pumping device, pressurized at high pressure and conveyed via a connecting element 18 into the receiving space 16 of the fuel distribution rail 12.

At least substantially circular connection openings 24 are formed on one side 20 of a surface 22 of the fuel distribution rail 12, through which the pressurized fuel can be discharged from the receiving space 16. Furthermore, valve pots 26 are arranged on the side 20, which are in fluid communication via the connection openings 24 with the receiving space 16. By means of the valve pots 26, injection valves are in fluid communication via the connection openings 24 with the fuel distribution rail 12 and in particular with the receiving space 16 to so that the pressurized fuel can flow via the connection openings 24 to the fuel valves, and be injected via the fuel valves directly into a respective cylinder of the internal combustion engine.

Figure 3:
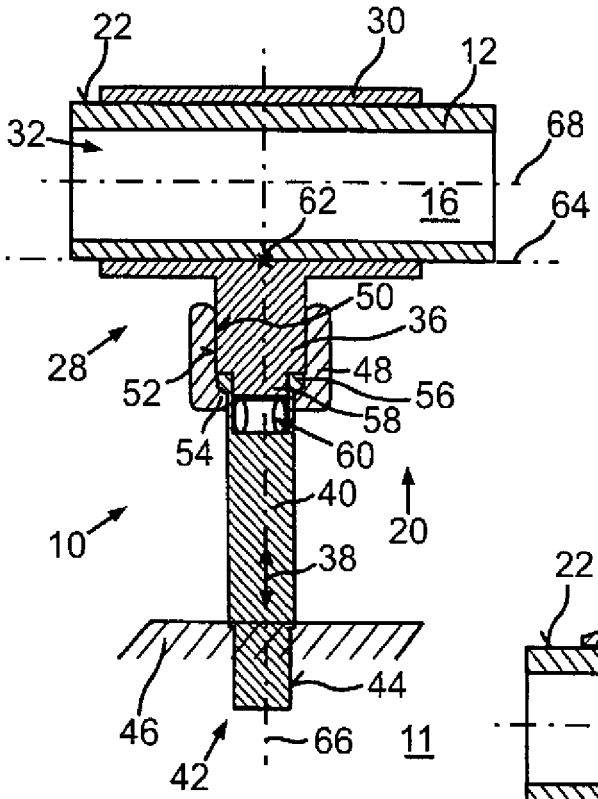
FIG. 3 a fragmentary schematic longitudinal sectional view of a fastening arrangement of the fuel supply device according to FIGS. 1 and 2 on the cylinder head in a region of a first connection location with the cylinder head.
Figure 4:
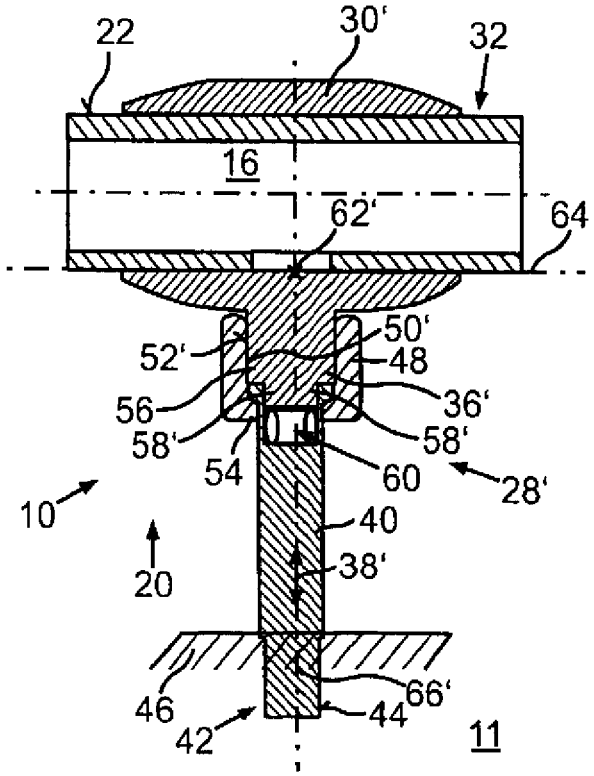
FIG. 4 another fragmentary schematic longitudinal sectional view of the fastening arrangement according to FIG. 3 at another connection location with the cylinder head of the internal combustion engine.
Figure 7:
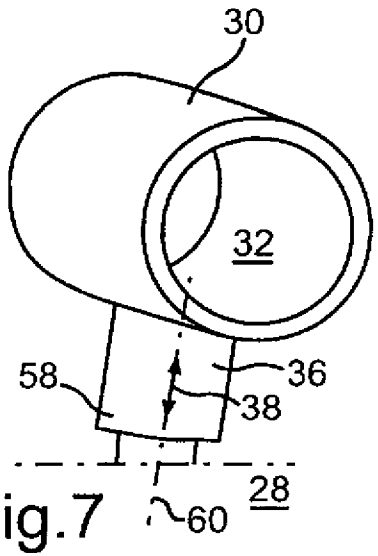
FIG. 7 a schematic perspective view of a junction element of the fuel supply device according to the preceding figures, for fastening the fuel supply device to the cylinder head of the internal combustion engine.

FIGS. 3 and 4 show a fastening arrangement 11 of the fuel supply device 10 on the cylinder head 46. To connect the fuel supply device 10 to the cylinder head 46 of the internal combustion engine, the fuel supply device 10 includes junction elements 28 and 28', with FIG. 7 showing the junction element 28 on an enlarged scale. The junction elements 28 and 28' each have a receiving part 30 and 30', which each form a respective seat 32 and 32'. The fuel distribution rail 12' is arranged with respective sections in the seats 32 and 32', wherein the seats 32 and 32' completely surround to respective sections and thus the fuel distribution rail 12 on the outer peripheral surface in the circumferential direction of the fuel distribution rail 12 in accordance with a directional arrow 34. Connecting elements 36 and 36' of the junction elements 28 and 28' are integrally formed with the receiving parts 30 and 30'. The connecting elements 36 and 36' are at least substantially rod-shaped and extend along a longitudinal direction according to directional arrows 38 and 38'. The connecting elements 36 and 36' extend at least substantially perpendicular to the fuel distribution rail 12.

Furthermore, the fuel supply device 10 includes stud bolts 40, which are also at least substantially rod-shaped, which extend along a respective longitudinal direction of the directional arrows 38 and 38' and are at least substantially perpendicular to the fuel distribution rail 12. The stud bolts 40 have each a threaded portion 42, in which a respective external thread 44 is formed, via which the stud bolts 40 are connected to the cylinder head 46 of the internal combustion engine. The stud bolts 40 are screwed into corresponding female threads 46 of the cylinder head 44 which are complementary to the external threads 44. The stud bolts 40 can thus be connected in their axial direction with the cylinder head 46 in a time-saving and cost-effective manner according to the directional arrows 38 and 38'.

Figure 5:
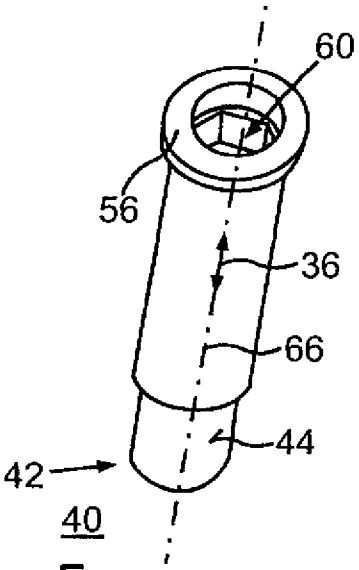
FIG. 5 a schematic perspective view of a stud bolt of the fuel supply device according to the preceding figures, for fastening the fuel supply device to the cylinder head of the internal combustion engine.

As particularly illustrated in FIG. 5, the stud bolts 40 have an interior tool connection, for example a hexagon socket, which can be used to screw the stud bolts 40 into the cylinder head 46, for example, with a corresponding tool at a predetermined torque.

Figure 6:
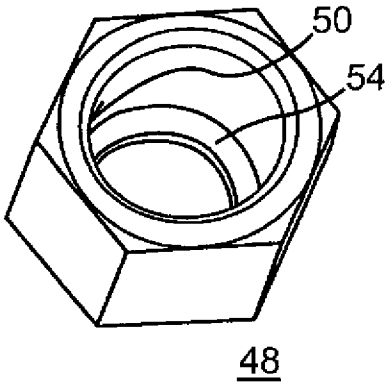
FIG. 6 a schematic perspective view of a union nut of the fuel supply device according to the preceding figures, for fastening the fuel supply device to the cylinder head of the internal combustion engine.

To connect the junction elements 28 and 28' to the stud bolts 40 and thus fasten the fuel supply device 10 on the cylinder head 46, the fuel supply device 10 includes union nuts 48, wherein FIG. 6 shows one of the union nuts 48 on an enlarged scale. The union nuts 48 have each an internal thread 50 which is used to screw them to a mating outer thread 52 and 52' of the connecting elements 36 and 36'. The union nuts 48 also have a collar 54, with which they are supported in the axial direction on a corresponding limit stop 56 of the stud bolts 40. By screwing the union nuts 48 together with the connecting elements 36 and 36' and by supporting the union nuts 48 on the stud bolts 40, the connecting elements 36 and 36' can be tensioned by the stud bolts 40 in the axial direction and thus connected to one another.

As shown in particular in FIGS. 3 and 4, the connecting elements 36 and 36' have each an alignment pin 58 and 58' with which the connecting elements 36 and 36' can be centered and precisely coaxially arranged relative to the stud bolts 40. To this end, the stud bolts 40 each have a seat 60, in which the alignment pins 58 and 58' are each received.

When fastening the fuel supply device 10 to the cylinder head 46, the union nuts 48 are first threaded onto the stud bolts 40, whereafter the stud bolts 40 are screwed in the cylinder head 46. The union nuts 48 can be threaded very fast due to the at least substantially rod-shaped design of the stud bolts 40. The fuel distribution rail 12 is inserted into the seats 32 and 32' ahead of time, simultaneously or at a later time, wherein the junction elements 28 and 28' are optionally attached to the fuel distribution rail 12, for example by a material joint. The junction elements 28 and 28' are, for example, castings, forgings, or an assembly of several parts, which are soldered together and/or welded together to form the junction elements 28 and 28'.

Thereafter, the alignment pins are placed 58 and 58' in the seats 60, so that the fuel distribution rail 12 can be positioned very precisely relative to the stud bolts 40 and the cylinder head 46. Thereafter, the union nuts 48 are screwed together with the junction elements 28 and 28', thereby securing the fuel distribution rail 12 particularly firmly to the cylinder head 46 in the axial direction of the stud bolts 40 and the connecting elements 36 and 36' in accordance with the directional arrows 38 and 38'.

With this attachment of the fuel supply device 10 to the cylinder head 46, fastening elements, such as sleeves, which are inserted through the fuel distribution rail 12 and the receiving space 16, and the through-openings of the fuel distribution rail 12, through which these fastening elements can pass through the fuel distribution rail 12, can be eliminated. Inserting such fastening elements through the fuel distribution rail 12 may create a not insignificant risk that cracks and thus leaks can form during the operation of the fuel supply device, when the fuel is injected into the cylinders at high pressure, if appropriate precautions are not taken. The risk for the formation of crack and leaks exists in particular in the edge regions of the through-openings, through which the fastening elements, such as the sleeves, pass through the fuel distribution rail 12. This means that the likelihood of crack formation and leakage is very small with the fuel supply device 10.

In addition, the stud bolts 40 and the connecting elements 36 and 36' as well as the connection openings 24 are arranged on a common side 20 of the fuel distribution rail 12, so that at least substantially only tensile forces act on the stud bolts 40, the connecting elements 36 and 36' and the fuel distribution rail 12. These tensile forces can be absorbed particularly well because the seats 32 and 32' are completely enclosed over 360° in the circumferential direction of the fuel distribution rail 12.

Advantageously, the receiving parts 30 and 30' extend in the longitudinal direction according to the directional arrow 14 over a particularly long and large area of the surface 22, thus avoiding an undesirably high localized introduction of forces into the fuel distribution rail 12.

Furthermore, the tolerances associated with the fuel supply device 10 can be particularly easily controlled, as no soldered seals or other materially connected surfaces exist. In addition, the fuel supply device 10 has a very low parts count, because only the junction elements 28 and 28', the union nuts 48 and the stud bolts 40 are provided for fastening the fuel supply device 10 to the cylinder head 46.

Advantageously, locations 62 and 62' disposed in elongation of the longitudinal direction of the connecting elements 36 and 36' according to the directional arrows 38 and 38' are located on a straight line 64 which connects the connection openings 24 and in particular centers of the at least substantially circular connection openings 24 with one another. In other words, the stud bolts 40 and the connecting elements 36 and 36' each have corresponding coaxially arranged longitudinal center axes 66 and 66', which intersect the extension of the outer surface 22 at respective locations of intersection which are the locations 62 and 62'. Because the locations 62 and 62' are located on the straight line 64, the stud bolts 40, the connecting elements 36 and 36' and the valve pots 26 are also located in a common plane, in particular in relation to a respective central plane. In this way, undesirable transverse moments acting on corresponding connection locations of the connecting elements 36 and 36' with the fuel distribution rail 12 and/or with the stud bolts 40 and/or with corresponding connection locations between the stud bolts 40 and the cylinder head 46 are at least substantially eliminated or kept very small. At least only substantially axial forces, in particular tensile forces, act on the joints and on the fuel supply device 10 during the operation of the fuel supply device 10. This ensures a particularly strong attachment of the fuel supply device 10 to the cylinder head 46 over a long service life. In addition, the central axes 66 and 66' intersect a longitudinal center axis 68 of the fuel distribution rail 12, thereby also at least substantially eliminating eccentric forces and moments.

Figure 8:
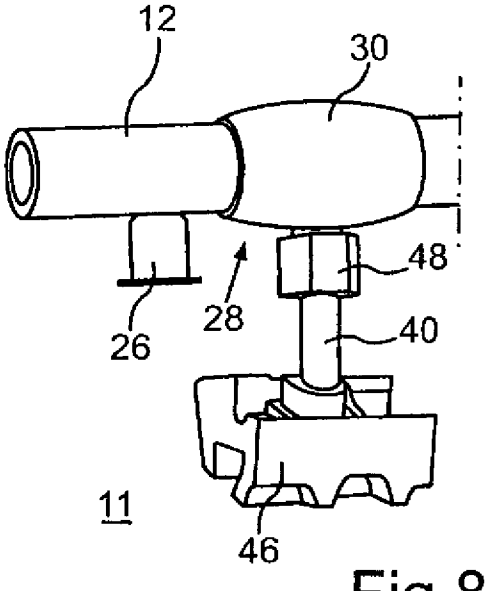
FIG. 8 a schematic fragmentary perspective view of the fastening arrangement according to FIG. 3.

FIG. 8 shows the fastening arrangement 11 according to in FIG. 3. As can be seen, the union nut 48 has a tool engagement in form of an external hex, via which the union nut 48 can be fastened with a tool for connecting the receiving part 30 with the stud bolt 40 via the connecting member 36.

Figure 9:
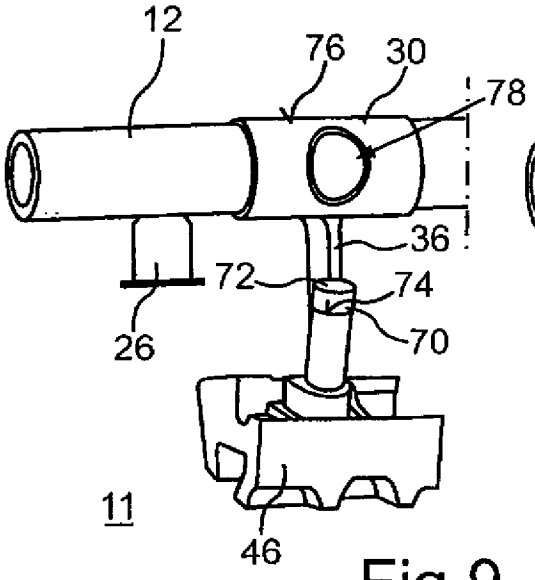
FIG. 9 a schematic fragmentary perspective view of another embodiment of the fastening arrangement according to FIG. 8.

FIG. 9 shows another embodiment of the fastening arrangement 11, wherein the stud bolt(s) 40 is/are omitted. In the fastening arrangement 11 according to FIG. 9, the receiving part 30 and the connecting element 36 are integrally formed with each other, wherein the connecting element 36 is fastened directly to the cylinder head 46. This means that the connecting element 36 is attached to the cylinder head 46 without an intermediate part, i.e. without the intermediate stud bolt 40. The connecting element 36 is directly supported on the cylinder head 46 and fastened to the cylinder head 46 with a screw 70.

The screw 70 hereby passes through a through-hole of the connecting element 36 and is screwed into the cylinder head 46. The screw 70 is supported by its bolt head 72 on a supporting surface 74 of the connecting element 36 arranged on sides of the fuel distribution rail 12, so that the connecting element 36 and thus also the receiving part 30 integrally formed with the connecting element 36 are tensioned with the cylinder head 46 by the screw 70.

By integrally forming the receiving part 30 and the connecting element 36 as a single part and by connecting the connecting element 36 to the cylinder head 46 without any intermediate parts, the parts count of the fastening arrangement 11 and therefore its costs are particularly low.

For a particularly simple and therefore time-saving and cost-effective installation of the fastening arrangement 11, the receiving part 30 has a through-opening 78 on an outer circumferential side 76 facing away from the fuel distributor line 12. The through-opening 78 penetrating the outer peripheral surface of the receiving part 30 represents here a lateral recess of the outer peripheral surface (outer peripheral surface 76) of the receiving part 30, wherein the opening (through-opening 78) keeps the supporting surface 74 from at least partially overlapping the receiving part 30.

The screw 70 can then be secured in the cylinder head 46 with a fastening tool by bypassing the receiving part 30 and the fuel distribution rail 12. In other words, the in particular straight fastening tool moves past the fuel distribution rail 12 just on the side.

As can be seen from FIG. 9, the through-opening of the connecting element 36 penetrated by the screw 70 also is oriented at an angle relative to the longitudinal direction of the connecting element 36, so that the screw 70 can advantageously be particularly easily accessed. The angle enclosed by the through-opening and the longitudinal direction may be kept small by providing the through-opening 78 (recess).

Figure 10:
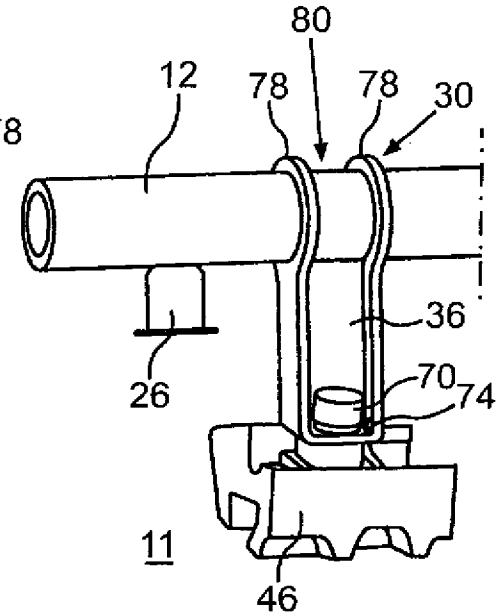
FIG. 10 a schematic fragmentary perspective view of another embodiment of the fastening arrangement according to FIGS. 8 and 9.

FIG. 10 shows another embodiment of fastening arrangement 11, wherein the receiving part 30 and the connecting element 36 are integrally formed as one piece. As in the fastening arrangement 11 according to FIG. 9, the connecting element 36 is directly supported on, i.e. without an intermediate part, of the cylinder head 46 and connected thereto by the screw 70. The surface normal of the supporting surface 74 on which the screw 70 is supported, and the longitudinal direction of the connecting element 36 enclose here an angle that is different from 0°. This realizes the at least partial lack of an overlap between the supporting surface 74 and the receiving part 30 and the fuel distribution rail 12, respectively, as already described for the fastening arrangement 11 in FIG.

9, so that the screw 70 is easily accessible and can be tightened with the fastening tool in a simple manner.

The screw 70 is furthermore easily accessible because the fuel distribution rail 12 is received in two annular segments 78 of the receiving part 30, wherein a recess 80 is provided between the ring segments 78. The assembly tool can then be moved past the fuel distribution rail 12 during the installation.

Figure 11:
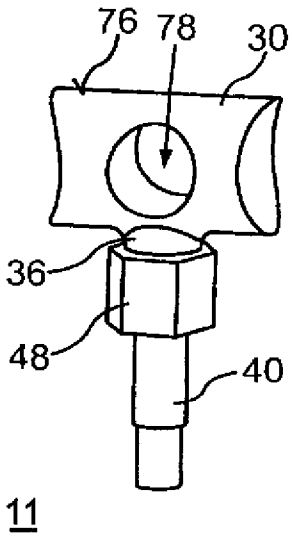
FIG. 11 a schematic perspective view of another embodiment of the fastening arrangement according to FIG. 8.

FIG. 11 shows another embodiment of the fastening arrangement 11 according to FIG. 8, wherein the receiving part 30, as in the fastening arrangement 1 according to FIG. 9, has a recess in the form of a through-opening 78 on its outer peripheral surface (outer peripheral surface 76).

Figure 12:
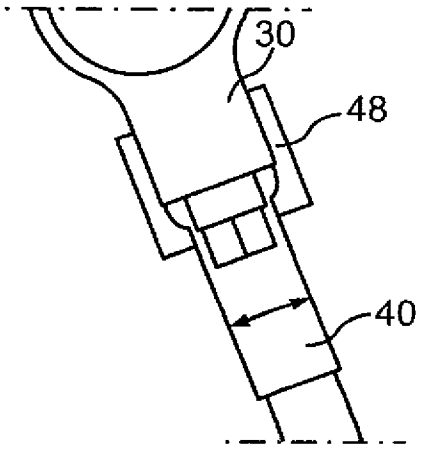
FIG. 12 a schematic fragmentary longitudinal section view of the fastening arrangement according to FIG. 11.

FIG. 12 shows the receiving part 30 with the connecting element 36 and the stud bolt 40 of FIG. 11 in a longitudinal sectional view. The stud bolt 40 and the connecting element 36 are interconnected by the union nut 48.

Figure 13:
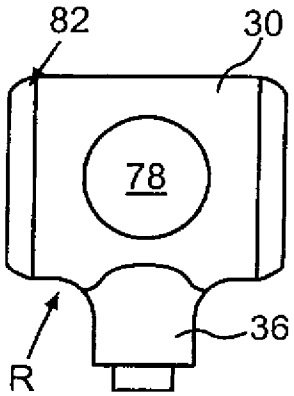
FIG. 13 a schematic side view of another embodiment of the fastening arrangement according to FIG. 11.
Figure 14:
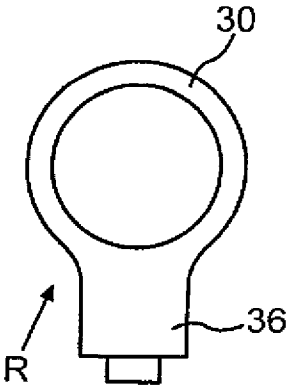
FIG. 14 a schematic plan view of the fastening arrangement according to FIG. 13.

FIGS. 13 and 14 show other embodiments of the receiving part 30 and connecting element 36 formed integrally therewith. The receiving part 30 and the connecting element 36 are formed, for example, as a one-piece cast component. Advantageously, respective radii R may be especially large so as to prevent stress peaks. In addition, a material transition 82 is provided. The material transition 82, also referred to as the material thickness transition, minimizes jumps in the rigidity on or to the fuel distribution rail 12.

FIGS. 15*a-e* show another embodiment of the receiving part 30 and the connecting element 36. The receiving part 30 and the connecting element 36 according to FIGS. 15*a-e* are formed as a one-piece cast component, and thus formed integrally with each other.

As with the fastening arrangement of FIG. 10, the connecting element 36 may in accordance with the cast component of FIGS. 15*a-e* be attached directly to the cylinder head 46, i.e. without an intermediate part. This keeps the parts count of the fastening arrangement 11 low.

For this purpose, the connecting element 36 has a through-opening 84 through which a screw, such as the screw 70, can pass. The screw 70 can be supported on the supporting surface 74 and thereby tension the cast component as well as the fuel distribution rail 12 with the cylinder head 46.

Figure 15A:
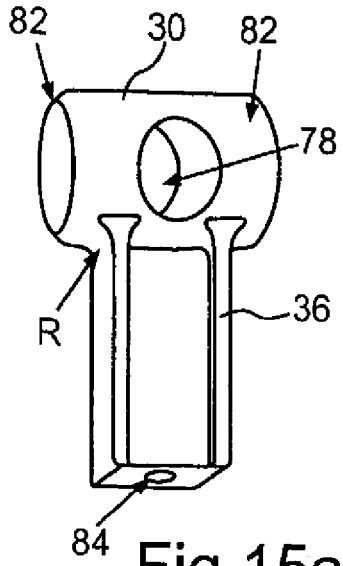
FIG. 15*a* a schematic perspective view of a receiving part and a connecting element of an embodiment of the fastening arrangement according to FIG. 11, wherein the receiving part and the connecting element are formed as an integral cast component.
Figure 15B:
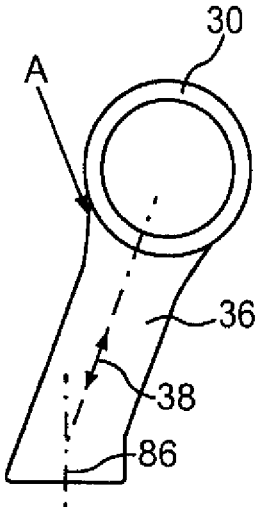
FIG. 15*b* a schematic plan view of the cast component according to FIG. 15*a;*
Figure 15C:
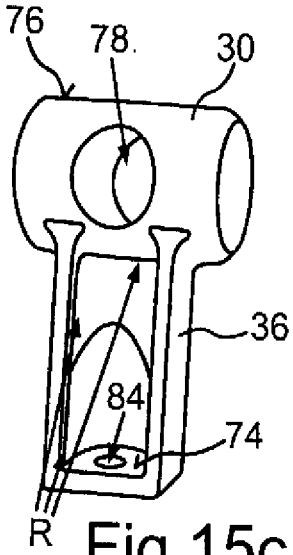
FIG. 15*c* another schematic perspective view of the cast component according to FIGS. 15*a-b;*
Figure 15D:
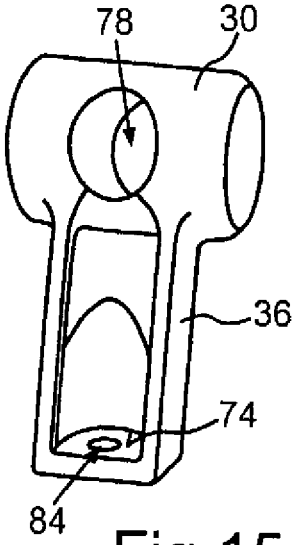
FIG. 15*d* another schematic perspective view of the cast component according to FIGS. 15*a-c*.
Figure 15E:
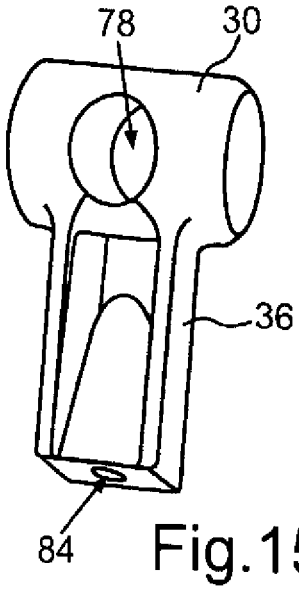
FIG. 15*e* another schematic perspective view of the cast component according to FIGS. 15*a-d.*

As shown particularly in FIG. 15*b*, the surface normal 86 of the supporting surface 74 facing the receiving part 30 and the fuel distribution rail 12 encloses with the longitudinal direction of the connecting element 36 indicated by directional arrow 38 an angle different from 0°. In the present embodiment, the angle is at least substantially 12°. In this way, the supporting surface 74 is with respect to the receiving part 30 arranged at least partially without overlap, so that the head of the screw 70 is accessible for installation. The installation tool for tightening the screw 70 can thus be guided laterally past the receiving part 30 and on the fuel distributor line 12, respectively.

In order to keep the angle between the longitudinal direction and the surface normal 86 small, the outer peripheral side 76 (outer peripheral surface) of the receiving part 30 has a recess which in this case is formed as a through-opening 78.

All the fastening arrangements 11 described with reference to FIGS. 1 to 15*e* advantageously enable a central and torque-free screw attachment of the fuel distribution rail 12 on the cylinder head 46. Furthermore, on the fuel distribution rail 12 lacks a fastening hole, thereby preventing undesirable and adverse weakening of the fuel distribution rail 12.

The invention claimed is:

1. A fastening arrangement, comprising an internal combustion engine, a fuel supply device, at least one fuel distribution element extending in a longitudinal direction and having at least two connection openings for connecting a respective fuel injection device, a receiving element comprising a seat receiving at least a portion of the at least one fuel distribution element and completely surrounding at least an outer peripheral area of the at least one fuel distribution element, and at least one connecting element configured to be fastened to the at least one fuel distribution element by way of the receiving element and extending downwardly from the receiving element, wherein the at least one connecting element has at least one supporting surface provided at its downward end which is opposite from the receiving element and supporting a fastening element for fastening the at least one connecting element on the internal combustion engine, wherein a location of the fuel distribution element disposed in an elongation of the at least one connecting element in an extension direction thereof is located on a straight line connecting the at least two connection openings, wherein the at least one connecting element extends downwardly from the receiving element in a longitudinal direction enclosing an acute angle with a surface normal of the supporting surface so that the supporting surface with respect to the receiving part is arranged partially with overlap and also partially without overlap in a horizontal direction to make a head of the fastening element accessible for installation.

2. The fastening arrangement of claim 1, wherein the at least one connecting element and the at least two connection openings are arranged on a common side of the at least one fuel distribution element.

3. The fastening arrangement of claim 1, wherein a longitudinal center axis of the at least one fuel distribution element is located in a plane, which is spanned by the straight line and the extension direction.

4. The fastening arrangement of claim 1, further comprising at least one additional connecting element which is positively or reversibly releasably connected with the at least one connecting element, wherein the at least one additional connecting element mediates connection of the fuel supply device to the internal combustion engine.

5. The fastening arrangement of claim 4, wherein the at least one connecting element and the at least one additional connecting element are connected by a screw element, wherein the screw element is screwed together with one of the at least one connecting element and is supported on the at least one additional connecting element by way of a limit stop.

6. The fastening arrangement of claim 5, wherein the screw element is a nut.

7. The fastening arrangement of claim 4, wherein one of the at least one connecting element is at least partly received in a seat of the additional connecting element.

8. The fastening arrangement of claim 1, wherein the at least one connecting element is substantially rod-shaped at least in regions and has a thread, via which the at least one connecting element is connected to the internal combustion engine.

9. The fastening arrangement of claim 8, wherein the thread is an external thread.

10. The fastening arrangement of claim 4, wherein the at least one additional connecting element is substantially rod-shaped at least in regions and has a thread, via which the at least one additional connecting element is connected to the internal combustion engine.

11. The fastening arrangement of claim 10, wherein the thread is an external thread.

12. The fastening arrangement of claim 1, wherein the at least one connecting element and the receiving element are integrally formed with each other.

13. The fastening arrangement of claim 1, wherein the receiving element and the fuel distribution element are connected with one another by a material joint.

14. The fastening arrangement of claim 12, wherein the at least one connecting element formed integrally with the receiving element is connected directly to the internal combustion engine.

15. The fastening arrangement of claim 1, wherein the longitudinal direction of the connecting element and the surface normal of the supporting surface enclose with one another the acute angle up to 12 degrees.

16. The fastening arrangement of claim 1, wherein the receiving element has at least one recess disposed on an outer peripheral side facing away from the fuel distribution element, wherein the recess of the receiving element at least partially prevents overlap between the supporting surface and the receiving element.

* * * * *